US008522404B2

(12) United States Patent
Matei

(10) Patent No.: US 8,522,404 B2
(45) Date of Patent: Sep. 3, 2013

(54) BUTTON ASSEMBLY

(76) Inventor: Danny Matei, Clinton Township, MI (US)

( * ) Notice: Subject to any disclaimer, the term of this patent is extended or adjusted under 35 U.S.C. 154(b) by 203 days.

(21) Appl. No.: 12/726,128

(22) Filed: Mar. 17, 2010

(65) Prior Publication Data

US 2010/0236029 A1 Sep. 23, 2010

Related U.S. Application Data

(60) Provisional application No. 61/161,449, filed on Mar. 19, 2009.

(51) Int. Cl.
*A44B 1/34* (2006.01)
*A44B 1/28* (2006.01)

(52) U.S. Cl.
USPC ..... 24/114.4; 24/108; 24/104

(58) Field of Classification Search
USPC ..... 24/144.4, 144.7, 104, 109, 112, 114.2, 24/102 SL
See application file for complete search history.

(56) References Cited

U.S. PATENT DOCUMENTS 312,943 A * 2/1885 Winans ..... 24/114.4
313,017 A * 2/1885 Noyes ..... 24/114.4
316,624 A * 4/1885 Howard ..... 24/114.4
323,358 A * 7/1885 Noyes et al. ..... 24/108
480,352 A * 8/1892 Turner ..... 24/109
505,479 A * 9/1893 Platt ..... 24/114.4
682,782 A * 9/1901 Beckwith ..... 24/108
1,183,422 A * 5/1916 Anderson ..... 24/102 SL
1,359,038 A * 11/1920 De Beaumont ..... 24/98
1,502,899 A * 7/1924 Bernardini et al. ..... 24/109
1,508,246 A * 9/1924 Pilcher et al. ..... 24/110
1,690,129 A * 11/1928 Prentiss ..... 24/114.4
2,014,814 A * 9/1935 Reiter ..... 24/108
2,658,249 A * 11/1953 Wilson ..... 24/102 SL
2,835,948 A * 5/1958 Blake ..... 24/108
2,901,796 A * 9/1959 Hope ..... 24/108
3,390,435 A * 7/1968 Zimber ..... 24/104
3,623,192 A * 11/1971 Papazian ..... 24/114.4
3,689,962 A * 9/1972 Erickson ..... 24/108
3,691,597 A * 9/1972 Kahn ..... 24/108
3,725,980 A * 4/1973 Burgio ..... 24/108
3,996,647 A 12/1976 Bengtsson
4,033,012 A 7/1977 Kramer et al.
RE29,729 E * 8/1978 Benmax ..... 24/114.3
4,606,097 A * 8/1986 Lam et al. ..... 24/108
4,662,034 A * 5/1987 Cunningham ..... 24/90.1
4,747,189 A * 5/1988 Hasegawa ..... 24/114.2
4,777,704 A * 10/1988 Acker ..... 24/106
4,817,249 A 4/1989 Astier
4,907,320 A 3/1990 Miao
4,918,791 A 4/1990 Hardin (Continued)

*Primary Examiner* — Robert J Sandy
*Assistant Examiner* — Rowland D Do

(57) ABSTRACT

A button assembly including a button head operable to rotate in three-dimensional space. The button assembly having a mounting portion and an elongated shaft attached to a base is provided. The button assembly includes a bearing member disposed on one end of the shaft. The bearing member is configured to fittingly engage the mounting portion of the button head so as to pivotably attach the button head to the shaft. The base may be inserted into an article of clothing in alignment with a corresponding buttonhole. Accordingly the user is able to rotate and pivot the button head about the bearing member of the shaft so as to facilitate the insertion of the button head into the buttonhole.

8 Claims, 5 Drawing Sheets

(56) References Cited

U.S. PATENT DOCUMENTS

| | | | | | |
|---|---|---|---|---|---|
| 4,926,527 | A | | 5/1990 | Sekiguchi | |
| 4,928,362 | A | | 5/1990 | Collas et al. | |
| 4,962,573 | A | * | 10/1990 | Breveglieri | 24/581.1 |
| 5,199,136 | A | | 4/1993 | McNerney et al. | |
| 5,575,043 | A | * | 11/1996 | Candotti | 24/114.4 |
| 5,622,257 | A | | 4/1997 | Deschenes et al. | |
| 5,655,271 | A | | 8/1997 | Maxwell-Trumble et al. | |
| 5,938,024 | A | | 8/1999 | Deschenes et al. | |
| 5,940,940 | A | | 8/1999 | Tanikoshi et al. | |
| 6,584,653 | B1 | | 7/2003 | Riley | |
| 2005/0210635 | A1 | * | 9/2005 | Ransom | 24/104 |

* cited by examiner

BUTTON ASSEMBLY

CROSS REFERENCE TO RELATED APPLICATION

This application claims the benefit of application Ser. No. 61/161,449 filed Mar. 19, 2009.

FIELD OF THE INVENTION

The present invention relates generally to a button assembly for buttoning an article of clothing. Specifically the present invention relates to a button assembly having pivotable button head pivotably mounted to a base.

BACKGROUND OF THE INVENTION

Buttons are used for fastening an article of clothing. For instance it is commonly known to sew a plurality of buttons onto a coat. The buttons are aligned to engage corresponding buttonholes so as to allow the coat to be fastened. Accordingly buttons are preferably mounted onto an article of clothing such that the button may be manipulated and inserted into a corresponding buttonhole of an article of clothing. However, the threads may wear over time as the button is subject to twisting and turning when inserted into the buttonhole. Thus, sewn buttons tend to fall off after a period of time.

It is also known to use mechanical devices to button an article of clothing together. For instance one such device disclosed in U.S. Pat. No. 3,705,443 to Camporese. The '433 patent discloses a button assembly including a base, an elongated shaft, and a button head. The elongated shaft has a pointed end which is operable to engage a receiving portion of the button head. However such configuration does not allow the button head to rotate in three-dimensional space about the shaft. Thus, the pointed end of the shaft is placed through a buttonhole and the button head is mounted thereon. Naturally, the button head may be separated from the base and thus render the device inoperable.

Accordingly it is desirable to have a button assembly wherein the button head is able to rotate in all directions so as to accommodate the insertion of the button head into a buttonhole. It is further desirable to have a button assembly wherein the button head is retained onto the base so that the two pieces remain together thus mitigating the chances of losing one piece and rendering the device inoperable.

SUMMARY OF THE INVENTION AND ADVANTAGES

A button assembly including a button head having a mounting portion and an elongated shaft attached to a base is provided. The button assembly includes a bearing member disposed on one end of the shaft. The bearing member is configured to fittingly engage the mounting portion of the button head so as to pivotably attach the button head to the shaft. The base may be inserted into an article of clothing in alignment with a corresponding buttonhole. Accordingly the user is able to rotate and pivot the button head about the bearing member of the shaft so as to facilitate the insertion of the button head into the buttonhole.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 7:
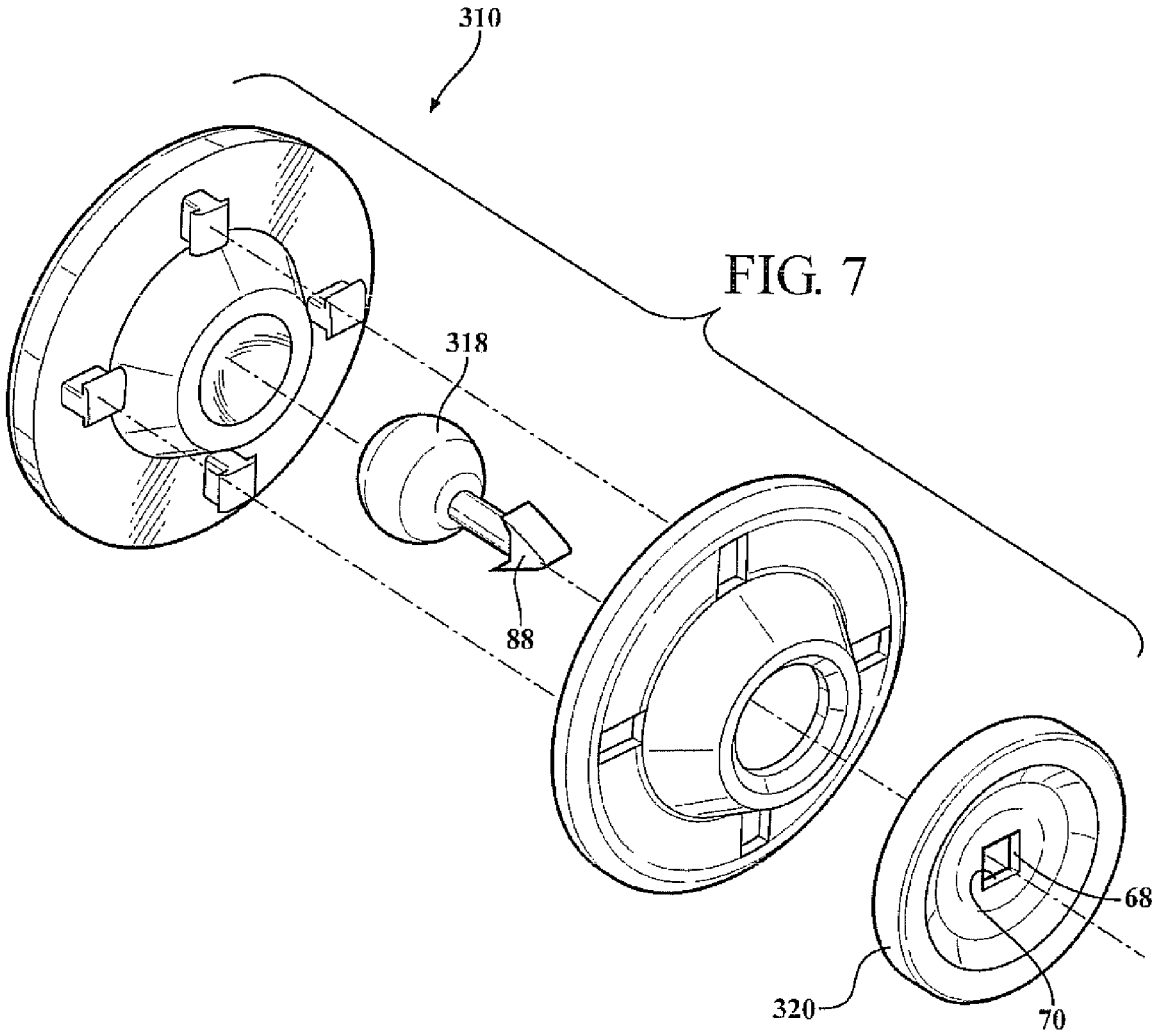
FIG. 7 is a perspective view of the fourth preferred embodiment of the present invention.

With reference to the Figures a button assembly 10 is provided. The button assembly 10 has a button head 12 with a mounting portion 14, an elongated shaft 16 having a bearing member 18, and a base 20. The base 20 is attached to one end of the elongated shaft 16 and the bearing member 18 is attached to the other end of the elongated shaft 16. The bearing member 18 is pushed through a portion of an article of clothing 22 so as to place the base 20 on the other side of the article of clothing 22. The button head 12 may then be mounted onto the bearing member 18 so as to rotatably attach the button head 12 to the shaft. The button head 12 may be manipulated to facilitate insertion of the button head 12 into a buttonhole 24, as shown in FIG. 7. Specifically, the button head 12 may be rotated in three-dimensional space.

The button head 12 may be made of any material currently known and used in the art such as plastic, metal, brass and the like. The button head 12 has an outer surface 26 which may be adorned with features to provide an aesthetically pleasing look. For instance, the outer surface 26 may be brass plated, or include a logo or other indicia. The button head 12 further includes a back side 28 opposite the outer surface 26.

Figure 1:
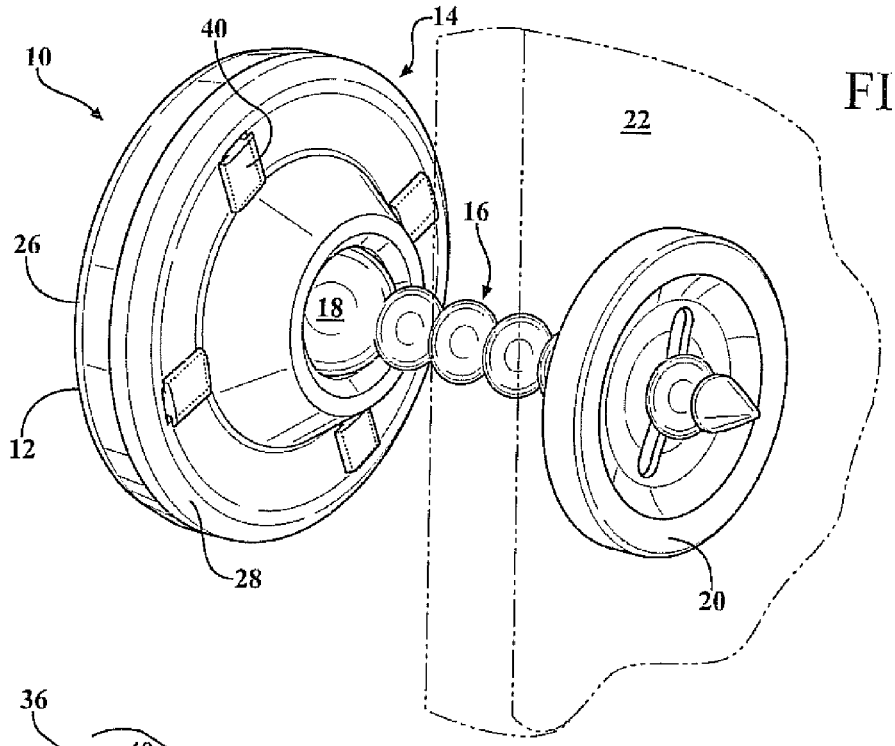
FIG. 1 is a perspective view of the first preferred embodiment of the present invention.

With reference now to FIG. 1, a first preferred embodiment of the button assembly 10 is provided. The mounting portion 14 may be disposed on the back side 28 of the button head 12. The mounting portion 14 may be integrally formed to the button head 12 or may be attached thereon using known attaching methods such as welding, adhesives or the like. The mounting portion 14 has an opening 30 leading into a chamber 32. The chamber 32 includes a first inner wall surface 34 that is generally hemispherical. The opening 30 is configured to fittingly receive the bearing member 18.

The bearing member 18 is disposed on one end of the elongated shaft 16. The other end of the elongated shaft 16 is fixedly mounted to the base 20. The bearing member 18 is generally spherical and is formed from a resilient material, such as plastic or metal. The bearing member 18 may be pushed through the opening 30 of the mounting portion 14 in what is commonly referred to by those skilled in the art as a snap fit engagement. The bearing member 18 is disposed within the hemispherical chamber 32 of the mounting portion 14 so as to couple the elongated shaft 16 to the button head 12. The bearing member 18 is rotatably disposed within the chamber 32 so as to allow the button head 12 to pivot generally freely in three-dimensional space.

Bearing members 18 currently known and used in the art are adaptable for use herein, illustratively including a ball bearing. The ball bearing is generally round and rigidly attached to the free end of the shaft. Preferably a portion of the ball bearing extends outwardly beyond the opening 30 of the mounting portion 14 so as to provide for a greater range of motion of the button head 12 around the bearing assembly. The button head 12 is rotatable about the bearing member 18 so as to be tilted with respect to the elongated shaft 16. For instance, the button head 12 may be turned freely so as to complete revolutions around the bearing assembly while simultaneously pivoting such that the plane defined by the back side 28 of the button head 12 is angled relative to the axis of the elongated shaft 16.

Figure 2:
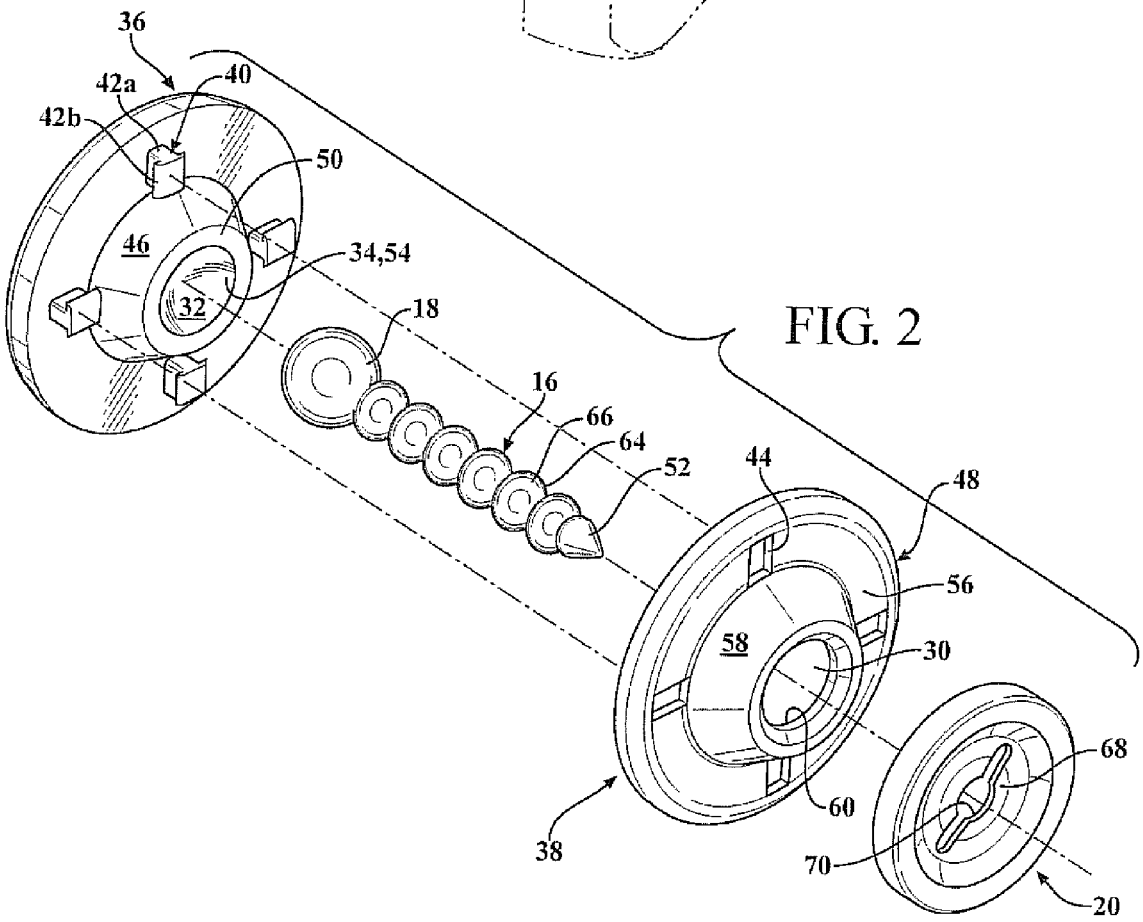
FIG. 2 is an exploded view of FIG. 1.

With reference now to FIG. 2, an exploded view of the first preferred embodiment of the invention is provided. The button head 12 includes a first head portion 36 and a second head portion 38. The first head portion 36 includes the outer surface 26 of the button head 12. The second head portion 38 includes the back side 28 and the mounting portion 14. The first head portion 36 further includes a fastener 40. The fastener 40 is generally a male portion 42*a* extending outwardly from the surface opposite the outer surface 26. The fastener 40 may further include flanges 42*b* disposed on the free end of the male portion 42*a*. The second head portion 38 further includes a female portion 44 configured to engage the fastener 40 so as to couple the first and second head portions 36, 38 together. The button head 12 may be injection molded, and the first head portion 36 is coupled to the second head portion 38 in a snap fit engagement.

The mounting portion 14 includes a first mounting portion 46 and a second mounting portion 48. The first mounting portion 46 is disposed on the first head portion 36 and the second mounting portion 48 is disposed on the second head portion 38. The first mounting portion 46 is generally cone shaped. The first mounting portion 46 includes first support member having a rim 50 bounding the chamber 32, also referenced herein as a hemispherical pocket 32. The hemispherical pocket 32 is defined by the first inner wall surface 34. The first inner wall surface 34 is generally hemispherical and configured to receive the bearing member 18 of the elongated shaft 16. The second mounting portion 48 includes a second support member 56 having a body 58. The body 58 of the second support member 56 includes an inner body surface 60 adapted to engage the first support member. The second mounting portion 48 further includes an aperture 62 configured to receive a portion of the elongated shaft 16.

The elongated shaft 16 may be made from a rigid material such as metal or a hardened composite such as plastic. Preferably, the elongated shaft 16 includes a plurality of grooves 64 disposed along the outer surface. Each of the plurality of grooves 64 is spaced apart from the other and extends annularly along the outer surface 26 of the elongated shaft 16 so as to bound the outer surface 26 of the elongated shaft 16. The plurality of grooves 64 forms circumferential ridges 66 on the outer surface 26 of the elongated shaft 16. The elongated shaft 16 may further include a piercing member 52 disposed opposite the bearing member 18.

The base 20 may be formed of material similar to that of the elongated shaft 16. The base 20 includes a receiving portion 68. The receiving portion 68 of the base 20 includes an inner peripheral wall 70 defining an aperture 62. Preferably the aperture 62 is shaped like a slit. The elongated shaft 16 may be inserted within the slit of the receiving portion 68 so as to selectively engage the inner peripheral wall 70 with one of the plurality of grooves 64. Accordingly, the distance between the button head 12 and the base 20 may be adjusted.

The base 20 may further include a plurality of teeth 72 disposed on the surface of the base 20. The plurality of teeth 72 is operable to engage an article of clothing 22 so as to help retain the base 20 to the article of clothing 22. Alternatively, the base 20 may include a layer of adhesive 73 for attaching the base 20 to the article of clothing 22. Other known methods for attaching the base 20 to the article of clothing 22 may be employed, for instance, a base 20 made of heat stakeable material such as plastic may be heat sealed to the article of clothing 22.

In assembly, the elongated shaft 16 is pushed through the aperture 62 of the second mounting portion 48 so as to place the bearing member 18 within the body 58 of the second mounting portion 48. The first head portion 36 is then coupled to the second head portion 38 so as to enclose the bearing member 18 between the body 58 of the second support member 56 and the first inner wall surface 34 of the first mounting portion 46. The button head 12 may then move in three-dimensional space about the bearing member 18.

The base 20 may be positioned on one side of an article of clothing 22, and the piercing member 52 of the base 20 may be used to pierce through the clothing and engage the receiving portion 68 of the base 20. Thus the button assembly 10 is fastened to the article of clothing 22. Preferably, the button assembly 10 is fastened along a portion of the article of clothing 22 corresponding to a buttonhole 24, as shown in FIG. 7. The button head 12 may be rotated to facilitate the insertion of the button head 12 into the corresponding buttonhole 24. Further, the button assembly 10 eliminates the time consuming chore of sewing buttons onto clothing.

Figure 3:
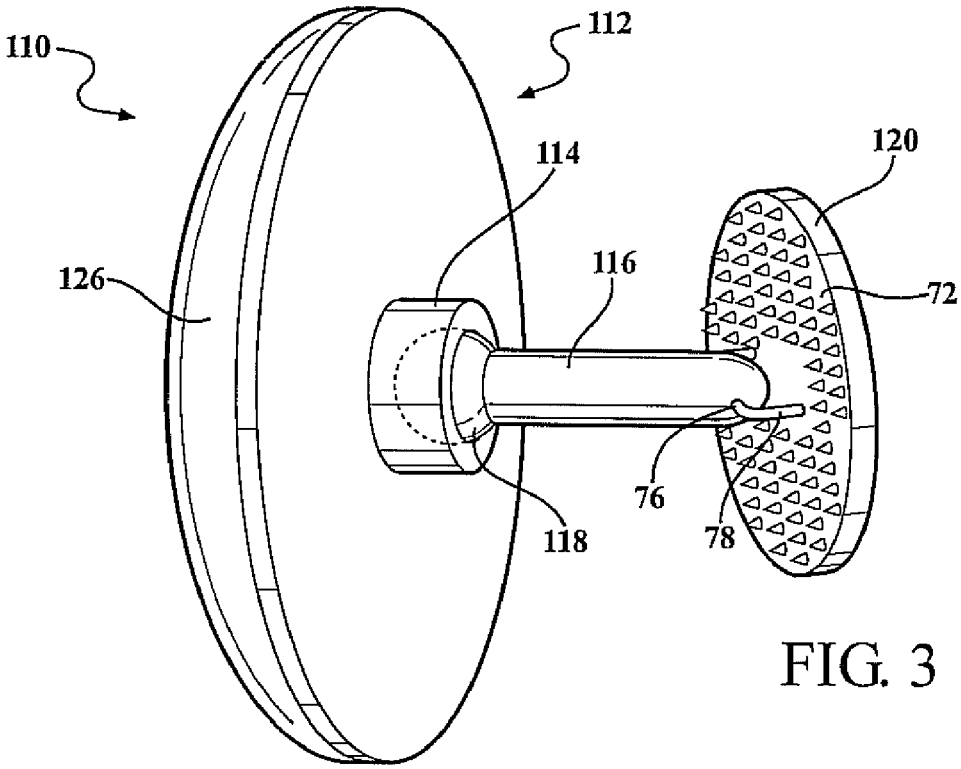
FIG. 3 is a perspective view of the second preferred embodiment of the present invention.
Figure 4:
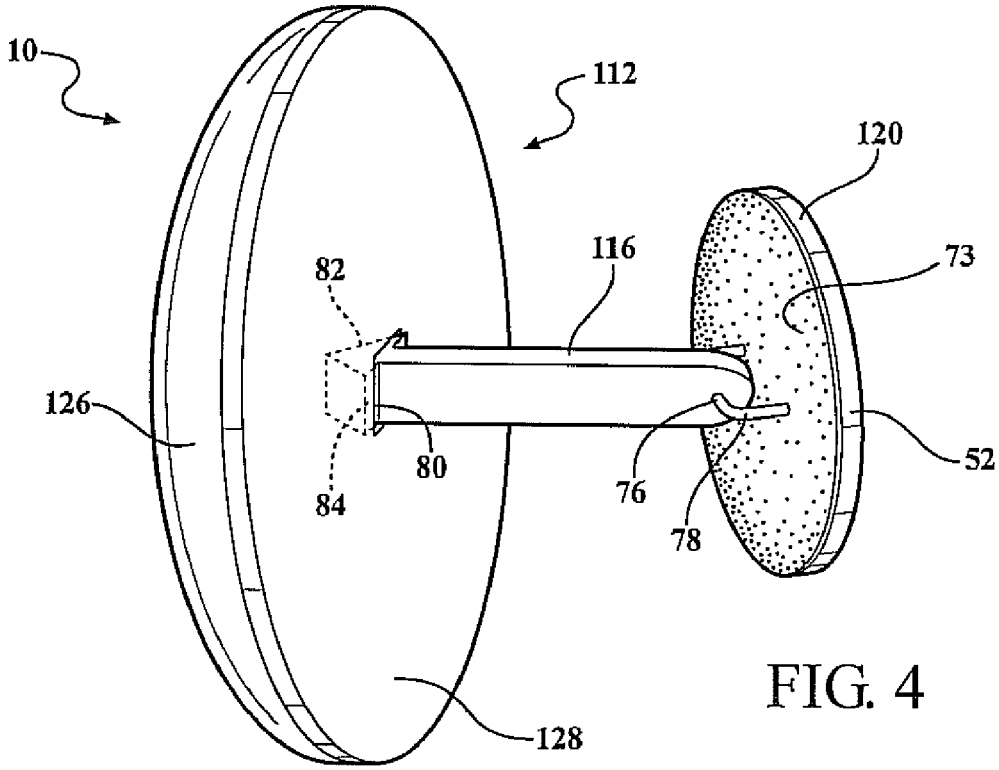
FIG. 4 is a perspective view of another embodiment of the second preferred embodiment of the present invention.
Figure 5:
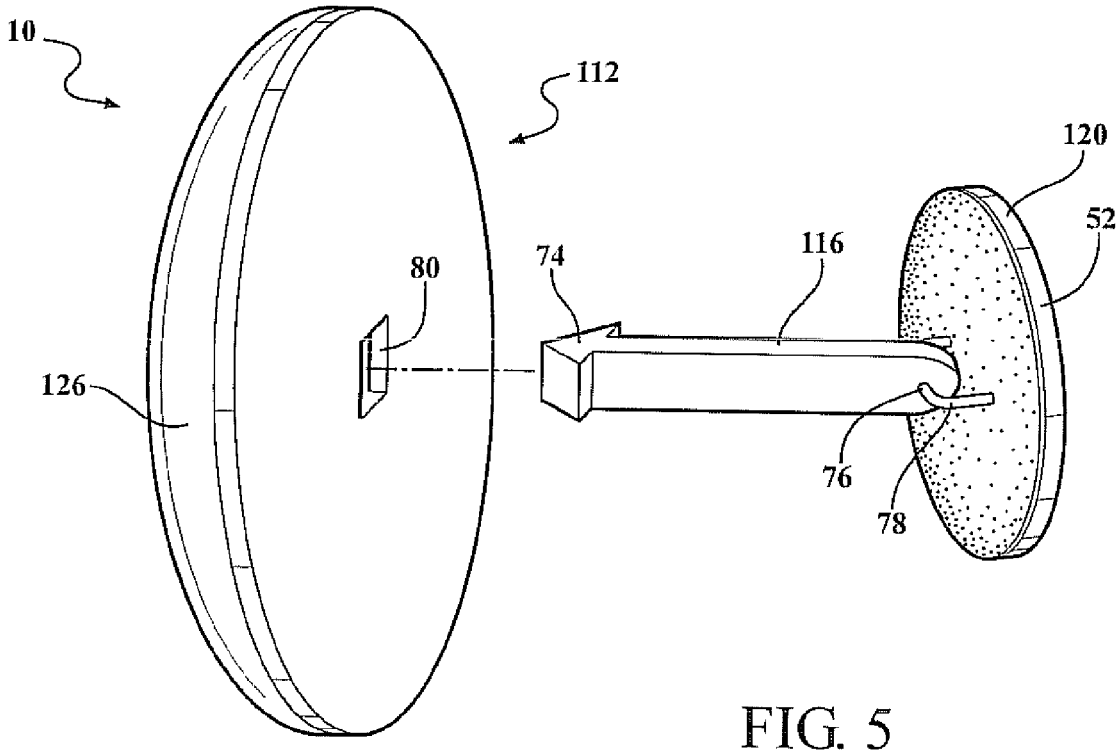
FIG. 5 is a perspective view of FIG. 4 showing the elongated shaft displaced from the base.

With reference now to FIGS. 3, 4, and 5 a second preferred embodiment of the button assembly 110 is provided, wherein like parts are indicated by numerals offset by 100. In the second preferred embodiment, the elongated shaft 116 is pivotably mounted to the base 120 and fixedly mounted to the button head 112. The elongated shaft 116 is formed of a resilient material such as plastic. The elongated shaft 116 includes a link aperture 76. The base 120 includes a link 78. The link 78 is fitted through the link aperture 76 and the each end of the link 78 is fixedly mounted to the base 120. A portion of the link 78 is raised above the base 120 so as to keep the end of the elongated shaft 116 free of the base 120 so as to facilitate the pivot of the elongated shaft 116 about the link 78.

With reference now to FIGS. 4 and 5, an embodiment of the second preferred embodiment is provided. The back side 128 of the button head 112 includes an arrow head opening 80 leading into a pocket 82 configured to receive the arrow head 74. The pocket 82 includes an inner wall surface 84. The elongated shaft 116 is coupled to the button head 112 by simply inserting the arrow head 74 into the arrow head opening 80. The arrow head 74 is compressed as it passes through the arrow head opening 80 and expands when fully disposed within the pocket 82. The ends of the arrow head 74 return to its natural state and prevent the elongated shaft 116 from being dislodged from the button head 112 by engaging the inner wall surface 84 of the pocket 82.

Figure 6:
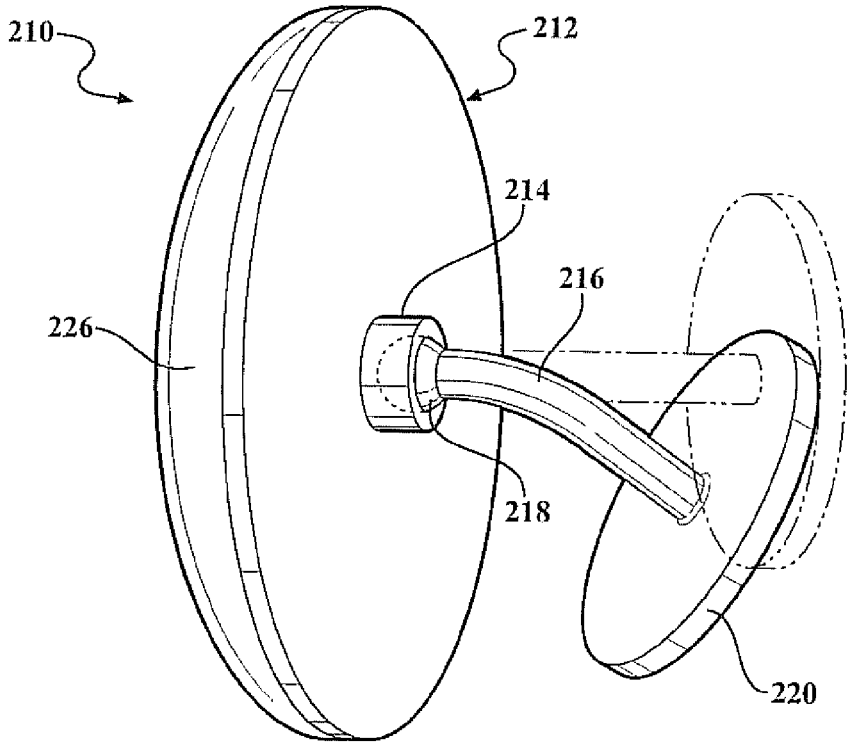
FIG. 6 is a perspective view of the third preferred embodiment of the present invention.

With reference now to FIG. 6, a third preferred embodiment of the button assembly 210 is provided, wherein like parts are indicated by numerals offset by 200. In the third preferred embodiment, the elongated shaft 216 is made of a flexible material such as rubber. The free end of the elongated shaft 216 is mounted onto the base 220, or may be integrally formed to the base 220. The bearing member 218 is disposed within the mounting portion 214. The button head 212 is pivotable in three-dimensional space, and the elongated shaft 16 may be flexed in three-dimensional space as well. Thus, the user may freely manipulate the button head 212 so as to facilitate the insertion of the button head 212 into a buttonhole 224.

With reference now to FIG. 7, a fourth preferred embodiment of the button assembly 310 is provided, wherein like parts are indicated by numerals offset by 300. In the fourth preferred embodiment, the base 320 is generally circular. The receiving portion 368 includes an inner peripheral wall 70 bounding space defining a square shaped aperture. The elongated shaft 316 is faulted from a resilient material such as plastic or rubber. The elongated shaft 316 includes a bearing member 318 on one end and a barbed end 88 opposite the bearing member 318. The barbed end 88 of the elongated shaft 316 is inserted into the receiving portion 368 so as to couple the elongated shaft 316 to the base 320 by a snap fit engagement.

Figure 8:
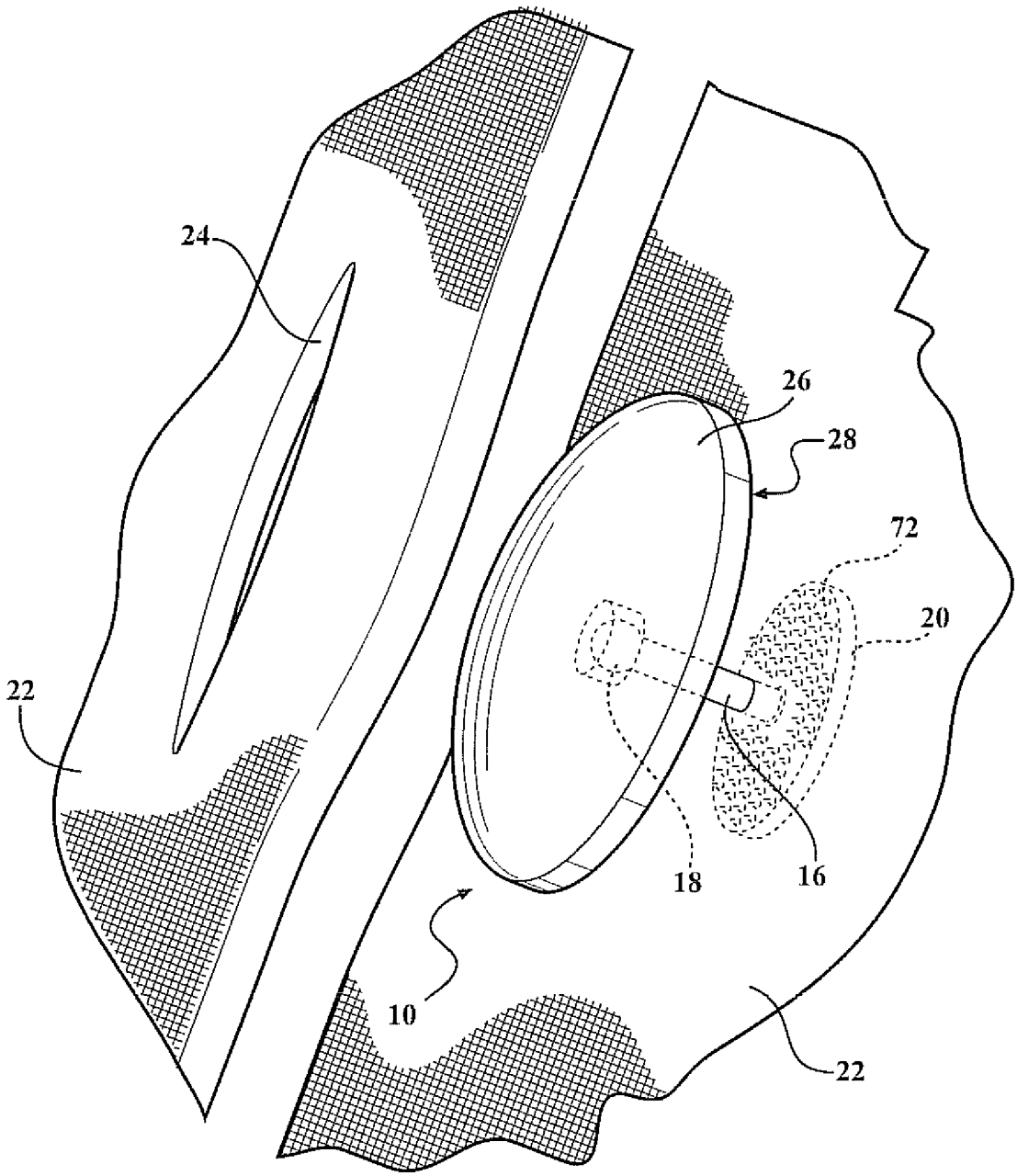
FIG. 8 is a perspective view of the first preferred embodiment of the present invention sewn onto an article of clothing.

With reference again to FIG. 8, a perspective view of the button assembly 10 mounted to an article of clothing 22 is provided. The button head 12 may be rotated in three-dimensional space to facilitate the insertion of the button head 12 into the corresponding buttonhole 24. Further, the button assembly 10 eliminates the time consuming chore of sewing buttons onto clothing. Yet another advantage of the present invention is that the button assembly 10 is more durable than buttons that are sewn onto an article of clothing 22. Specifically, dry cleaning and washing operations may cause threads to wear over time. However, the button assembly 10 of the present invention is mechanically linked to the article of clothing 22 and is formed from material that is more resilient than thread.

The invention has been described in an illustrative manner. It is therefore to be understood that the terminology used is intended to be in the nature of words of description rather than limitation. Many modifications and variations of the invention are possible in light of the above teachings without varying from the scope and spirit of the invention described herein.

We claim:

1. A button assembly comprising:

a button head having a first head portion and a second head portion, the first head portion having a fastener and the second head portion having a female portion configured to engage the fastener so as to couple the first and second head portions together, the button head further including a mounting portion having a first mounting portion and a second mounting portion, the first mounting portion is disposed on the first head portion and is generally cone shaped, a distal end portion of the first mounting portion having a pocket, the pocket being generally hemispherical, and the second mounting portion is disposed on the second head portion, and is shaped so as to slidingly engage an outer surface of the first mounting portion and partially enclose the pocket;

a base having a receiving portion; and an elongated shaft, the elongated shaft includes a plurality of grooves disposed along an outer surface of the elongated shaft, each of the plurality of grooves spaced apart from the other so as to define a plurality of ridges extending circumferentially about the elongated shaft, each of the plurality of ridges spaced apart from each other, wherein one end of the elongated shaft is configured to engage the receiving portion of the base and the other end of the elongated shaft includes a bearing member configured to be disposed within the pocket of the mounting portion of the button head wherein the button head is rotatable in three-dimensional space about the elongated shaft.

2. The button assembly as set forth in claim 1, wherein the bearing member is a ball bearing.

3. The button assembly as set forth in claim 1, further including a plurality of teeth disposed on the base.

4. The button assembly as set forth in claim 1, wherein the elongated shaft is made of a material selected from the group comprising of metal, rubber, plastic, and a treated polymeric composite.

5. The button assembly as set forth in claim 1, wherein the receiving portion of the base includes an inner peripheral wall defining an aperture, the elongated shaft selectively inserted within aperture of the receiving portion so as to selectively engage the inner peripheral wall with one of the plurality of grooves.

6. The button assembly as set forth in claim 1, wherein each of the plurality of grooves extends annularly along the outer surface of the elongated shaft so as to bound the outer surface of the elongated shaft.

7. The button assembly as set forth in claim 6, wherein the elongated shaft further includes a piercing member opposite the bearing member.

8. The button assembly as set forth in claim 1, wherein the second mounting portion is cone shaped.

* * * * *

UNITED STATES PATENT AND TRADEMARK OFFICE

CERTIFICATE OF CORRECTION

PATENT NO. : 8,522,404 B2
APPLICATION NO. : 12/726128
DATED : September 3, 2013
INVENTOR(S) : Danny Mattei It is certified that error appears in the above-identified patent and that said Letters Patent is hereby corrected as shown below:

In the Title Page:

Item (12) delete "Matei" and insert --Mattei--.

Item (76) delete "Danny Matei" and insert --Danny Mattei--.

Signed and Sealed this
Thirteenth Day of January, 2015

Michelle K. Lee

Michelle K. Lee
*Deputy Director of the United States Patent and Trademark Office*